US010380982B1

(12) United States Patent
Hovey

(10) Patent No.: US 10,380,982 B1
(45) **Date of Patent: *Aug. 13, 2019**

(54) SMART MUSIC DEVICE AND PROCESS THAT ALLOWS ONLY KEY CORRECT NOTES AND SCALES TO BE PLAYED

(71) Applicant: Dean Martin Hovey, Los Angeles, CA (US)

(72) Inventor: Dean Martin Hovey, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,027

(22) Filed: May 24, 2018

Related U.S. Application Data

(63) Continuation-in-part of application No. 15/687,988, filed on Aug. 28, 2017, now Pat. No. 10,026,385.

(60) Provisional application No. 62/380,256, filed on Aug. 26, 2016.

(51) Int. Cl.

| | |
|---|---|
| ***G04B 13/00*** | (2006.01) |
| ***A63H 5/00*** | (2006.01) |
| ***G10H 1/00*** | (2006.01) |
| ***G10H 1/34*** | (2006.01) |

(52) U.S. Cl.
CPC ..... *G10H 1/0016* (2013.01); *G10H 1/34* (2013.01); *G10H 2210/066* (2013.01); *G10H 2210/071* (2013.01); *G10H 2210/081* (2013.01); *G10H 2220/096* (2013.01)

(58) Field of Classification Search
CPC .. G10H 1/0016; G10H 1/34; G10H 2220/096; G10H 2210/081; G10H 2210/071; G10H 2210/066
USPC ..... 84/609
See application file for complete search history.

(56) References Cited

U.S. PATENT DOCUMENTS

| | | | | |
|---|---|---|---|---|
| 4,040,324 | A * | 8/1977 | Green | G09B 15/08 84/478 |
| 5,841,053 | A * | 11/1998 | Johnson | G10C 3/12 84/615 |
| 6,348,649 | B1 * | 2/2002 | Chen | G09B 15/02 84/464 A |
| 9,583,084 | B1 * | 2/2017 | Fagan | G10G 1/02 |
| 9,646,584 | B1 * | 5/2017 | Dorety | G10G 1/02 |
| 10,026,385 | B2 * | 7/2018 | Hovey | G10H 1/0066 |
| 2005/0005761 | A1 * | 1/2005 | Knudsen | G09B 15/023 84/645 |
| 2006/0243119 | A1 * | 11/2006 | Rubang, Jr. | G09B 15/023 84/609 |

(Continued)

*Primary Examiner* — Jeffrey Donels
(74) *Attorney, Agent, or Firm* — Plager Schack LLP; Mark H. Plager; Alexis J. Saenz

(57) ABSTRACT

A smart music device and process provide users with an interface to play a selected song in the correct song key. The device includes a graphical user interface with areas demarcated by translucent conductive ink printed on the layer's underside. A layer of force sensor resistors (FSRs) are under the areas. Touching one of the areas closes a circuit between then conductive ink and FSR triggering a note to be played. The demarcated areas are illuminated to guide the user on scale and root node position. Metadata in memory storage includes the song key which is used during song playback to trigger assignment of the key correct scale across the FSRs and illuminate its root position of musical notes. Touching an area triggers a signal sent to a connected musical instrument to play the note.

16 Claims, 5 Drawing Sheets

(56) References Cited

U.S. PATENT DOCUMENTS

| | | | | |
|---|---|---|---|---|
| 2010/0053105 | A1* | 3/2010 | Choi | G06F 3/04886 345/173 |
| 2010/0184497 | A1* | 7/2010 | Cichowlas | A63F 13/00 463/7 |
| 2014/0076126 | A1* | 3/2014 | Terry | G10H 1/34 84/609 |
| 2014/0305284 | A1* | 10/2014 | Cosgrove | G09B 15/001 84/478 |

* cited by examiner

SMART MUSIC DEVICE AND PROCESS THAT ALLOWS ONLY KEY CORRECT NOTES AND SCALES TO BE PLAYED

CROSS-REFERENCE TO RELATED APPLICATIONS

This application claims benefit under 35 U.S.C. § 119(e) of U.S. Provisional Application having Ser. No. 62/380,256 filed Aug. 26, 2016, and U.S. application Ser. No. 15/687,988, filed on Aug. 28, 2017, which are hereby incorporated by reference in their entirety.

BACKGROUND

The embodiments herein relate generally to musical devices and more particularly, to a smart music device and process that allows only key correct notes and scales to be played.

Musical instruments are difficult to play and can take years of training to master. Some electronic musical devices use push buttons or rubber pads to trigger notes making them cumbersome to play. Often, while one is playing (or learning to play), incorrect notes of the wrong key are played producing an undesirable sound. Others need a computer and additional software in order to function. Even so, the user may still often incorrectly play notes in the wrong key because they do not fully grasp the positions of keys on musical devices. This can often lead to frustration and a poor musical experience.

As can be seen there is a need for a device and method that improve on the music playing process.

SUMMARY

In one aspect, a smart music device comprises a graphical layer interface; conductive translucent ink on an underside of the graphical layer interface, the conductive translucent ink demarcating areas representing musical notes on the graphical layer interface; a layer of conductive sensors positioned below the conductive translucent ink demarcating areas representing musical notes, the layer of conductive sensors connected to a processing unit, wherein touching one of the areas demarcated to represent musical notes generates a conductive circuit between the translucent conductive ink and an underlying conductive sensor, and the processing unit; an LED source connected to the graphical layer and configured to illuminate the areas demarcated to represent musical notes; input/output ports configured to communicate data to an electronic musical instrument; data memory storage configured to electronically store song file metadata; and the processing unit which is configured to: analyze the song file metadata for a song key, determine musical notes to be played in the song key, assign to the areas demarcated to represent musical notes, only musical notes in the song key; illuminate the areas demarcated to represent only musical notes to be played in the song key, register a touch by the user of one of the demarcated areas in response to conductive ink under the touched demarcated area making contact with one of the conductive sensors, identify a musical note, in the song key, associated with the touched demarcated area, and send the identified musical note, in the song key, through the output port to the electronic musical instrument to be played.

In another aspect, a method for automatically generating only correct key notes and scales played through a smart music device comprises receiving a song to be played; analyzing the song for a song key; storing the song key in a metadata file associated with the song; receiving a request for playback of the song; retrieving the song key from the metadata file; assigning to user interface areas of the smart music device, only musical notes in the song key; illuminating the user interface areas of the smart music device that represent a root position of musical notes played in the song key in an order of musical notes for the song; registering a touch of user interface areas of the smart music device through a layer of conductive ink positioned on an underside of the user interface areas; identifying a musical note associated with one of the user interface areas touched in response to a circuit formed between the layer of conductive ink and a processing unit; and sending a signal from the processing unit through an output port of the smart music device to an input port of an electronic musical instrument to play the identified musical note.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
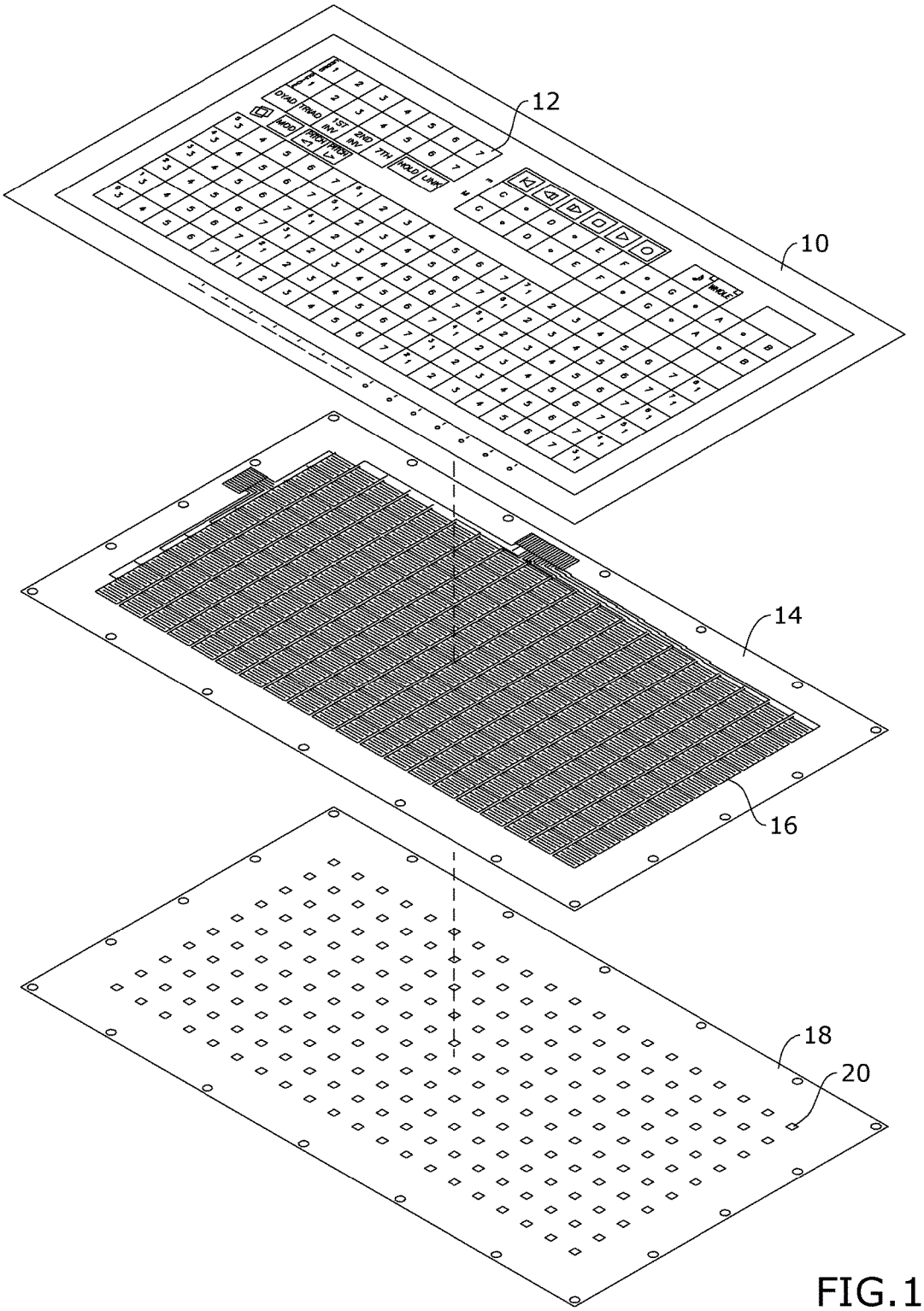
FIG. 1 is an exploded view of a smart music device according to embodiments of the subject technology.
Figure 2:
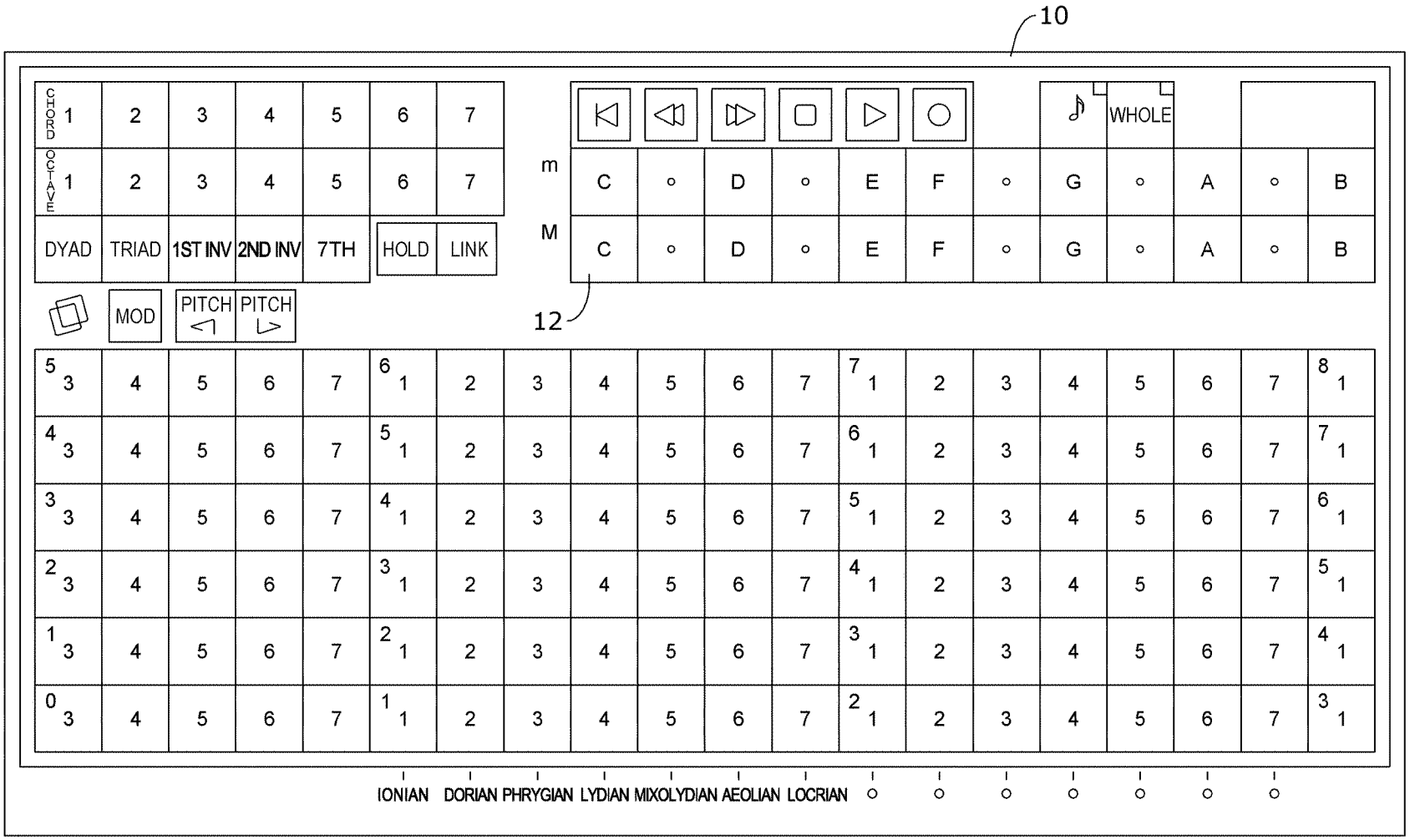
FIG. 2 is a top view of a graphics layer plate of the smart music device of FIG. 1.
Figure 3:
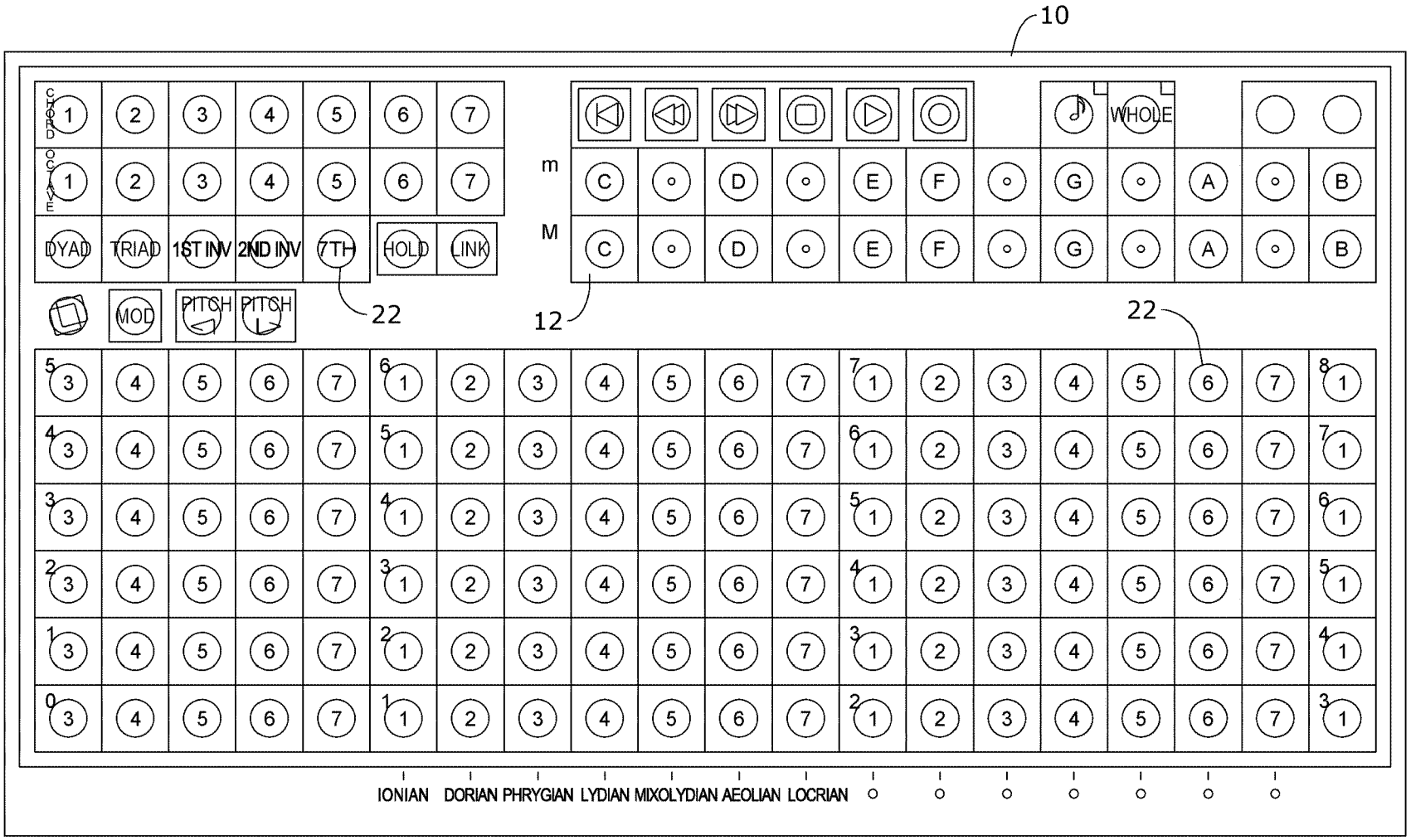
FIG. 3 is the graphics layer plate of FIG. 2 with force sensor resistor pads illuminated.
Figure 4:
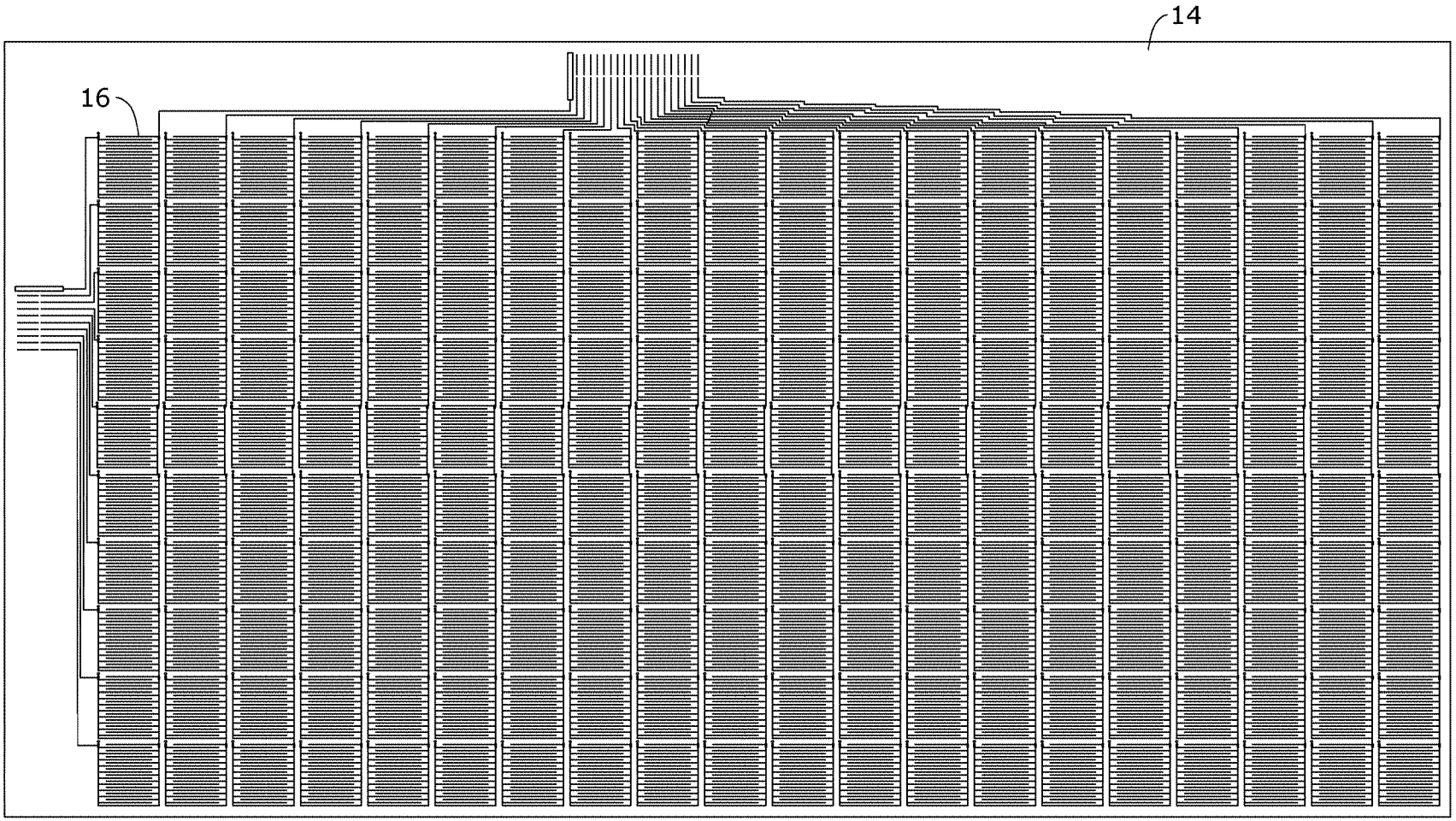
FIG. 4 is a top view of a force sensor resistor layer of FIG. 1 according to an exemplary embodiment.

In general, embodiments of the disclosed subject technology provide a smart music device and process that allows the user to play perfectly against any song without prior knowledge of music or how to play any particular instrument. As will be appreciated, even novice users may select a song to be played and the device will guide the user into registering the correct note within the correct key and scale when interacting with the device's input interface. In the following description, the term "key" refers to a group of notes based on a particular note and comprising a scale, regarded as forming the tonal basis of a piece or passage of music.

Referring to FIGS. 1-4, a smart music device (sometimes referred to in general as the "device") is shown according to an exemplary embodiment. The device includes a top graphics plate layer 10, a force sensor resistor (FSR) plate 14 positioned below the graphics layer plate 10, and a light emitting diode plate (LED) plate 18 positioned underneath the FSR plate 14. For sake of illustration, the backing or lower most layer of housing is omitted from view as are the power source, circuit boards (other than the FSR plate 14), and processing unit(s) which will be understood to be present under the LED plate 18.

Figure 5:
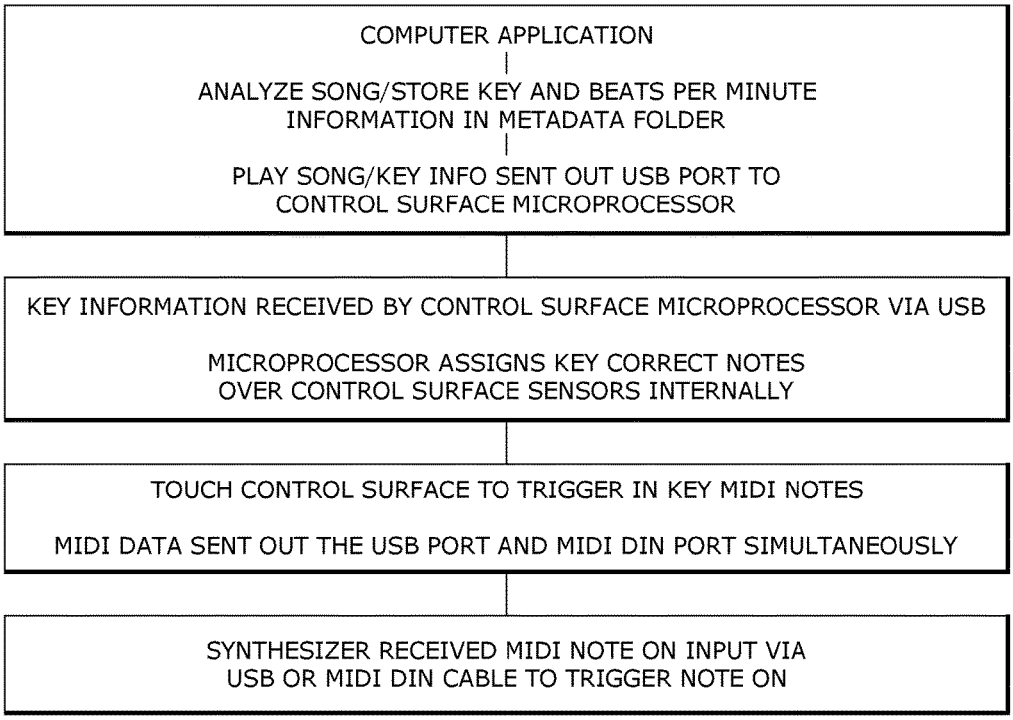
FIG. 5 is a flowchart of a method for generating only correct key notes and scales played on a smart music device according to an embodiment of the subject technology.

Referring temporarily to FIG. 5, in some embodiments, the device may include computing aspects and may generally be considered a computing device 500. The components of the computing device 500 may include, but are not limited to, one or more processors or processing units 510, a system memory 520, and a bus that couples various system components (for example, signals from the overlying graphics plate layer 10, FSR plate 14, and LED plate 18 to the system memory 520 to the processor 16. The computing device 500 may also communicate with one or more external devices such as a display 550, a microphone (not shown), a MIDI device (not shown), a music keyboard (not shown), or other musical device; and/or any devices (e.g., network card, modem, etc.) that enable the computing device 500 to communicate with one or more other computing devices. Such communication can occur via Input/Output (I/O) interfaces/ports 560. In some embodiments, the device may be connected to another musical device or computing device that play notes corresponding to the demarcated areas 12 touched through for example, MIDI I/O ports. For example, the processing unit 510 may include three separate processors with each dedicated to a specific task. One processor may be configured for key processing, one for MIDI output and one for MIDI input.

Figure 6:
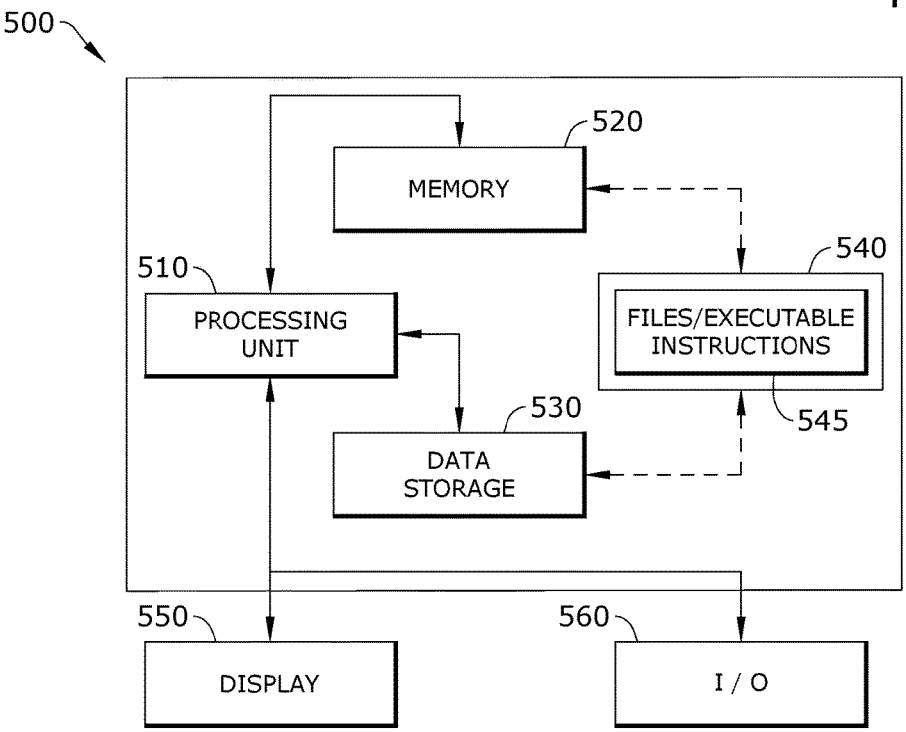
FIG. 6 is a block diagram of a computing device according to an embodiment of the subject technology.

Referring back to FIGS. 1-4 along with FIG. 6, operation of the layers 10, 14, and 18 are described in further detail. The graphics plate layer 10 is a playing surface. It triggers notes by registering touch from a user, the audio output of which is in key. In some embodiments, the graphics plate layer 10 may include a transparent or translucent vinyl surface that through touch, outputs pressure and location data through its linked to processing unit 510 allowing touch to generate musical notes within a specific key. The graphics plate layer 10 may have conductive translucent ink on its bottom side. As shown more clearly in FIG. 2, the graphics plate layer 10 may include demarcated areas 12 resembling buttons that have the conductive translucent ink on their bottom side of the area under the plate layer 10. The FSR plate 14 (FIG. 4) includes for example, 200 sensor points made up, in some embodiments, of a plurality of force sensor resistors 16. The demarcated areas 12 may be mounted over the FSR plate 14 sensor points so that when the user touches a demarcated area 12, registration of the demarcated area 12 touched is determined by the processing unit 510 according to the column and row transmitting the signal. When the graphics plate layer 10 is touched, the conductive ink will form a closed circuit with the underlying force sensor resistor 16 generating a signal sent through the processing unit 510 and the MIDI PC board for MIDI output to a synthesizer or audio device. As will be appreciated, by using a FSR configuration, virtual real-time registration of a note is triggered (as fast as 0.7 milliseconds) which eliminates audible lag in note playing and produces an improved musical output. The demarcated areas 12 and their corresponding force sensor resistors 16 may be configured to represent different notes in different keys and scales and functions. The processing unit 510 may be configured to map each of the demarcated areas 12 to a corresponding instrument key, note or function of a connected musical instrument. For example, indicia printed with the conductive translucent ink may represent notes, keys, octaves, chords, major/minor play, pitch, and play/stop/ff/rwd/rec functions. For example, touching an illuminated demarcated area 12 may send a signal that triggers play from an external device such as a MIDI player or keyboard. In one embodiment, the device may be in a locked key to prevent note errors while playing. The processing unit 510 also receives MIDI input from external audio sources and will assign matching key correct data upon its sensors so that users can play in perfect key alongside any song in real-time and without error.

The LED plate 18 board may have a plurality of LEDs. Typically, it may have the same number of LEDs as there are force sensor resistors 16 or demarcated areas 12. The LED plate 18 shines light through the FSR plate layer 14, the translucent ink and the graphics layer indicating accurately what key and mode the device is currently in. Elements designated with the reference numeral 22 represent demarcated areas 12 illuminated by the LED plate board 18.

In some embodiments, the processing unit 510 may also read incoming MIDI data allowing it to "Slave" to the key of a song being played on the computer allowing you to play along in perfect key and without error.

In some embodiments, the computing device 500 of the present disclosure may be described in the general context of computer system executable instructions, such as program modules, being executed to determine aspects related to the key needed for playing and to generate audio and/or visual output. The computing device 500 may typically include a variety of computer system readable media. Such media could be chosen from any available media that is accessible by the computing device 500, including non-transitory, volatile and non-volatile media, removable and non-removable media. The system memory 520 could include one or more computer system readable media in the form of volatile memory, such as a random-access memory (RAM) and/or a cache memory. By way of example only, a storage system 530 can be provided for reading from and writing to a non-removable, non-volatile magnetic media. The system memory 520 may include at least one program product 540 having a set (e.g., at least one) of program modules 545 that are configured to carry out the functions of embodiments of the subject technology. The program product/utility 540, having a set (at least one) of program modules 545, may be stored in the system memory 520 by way of example, and not limitation, as well as an operating system, one or more application programs, other program modules, and program data. Each of the operating system, one or more application programs, other program modules, and program data or some combination thereof, may include an implementation of a networking environment. The program modules 545 generally carry out the functions and/or methodologies of embodiments of the invention as described herein. For example, the program modules 545 may carry out the steps related to identifying a song file, extracting metadata, illuminating parts of the graphics layer plate 10 and registering user touch of the device for playback of musical notes as described more fully below with respect to FIG. 5.

Referring now to FIG. 5, a method for automatically generating only correct key notes and scales played through a smart music device is shown according to an exemplary embodiment. In some embodiments, a software application may be initialized before the device is operated. The user may select a song to be played on the device. Upon receiving the selected song, the processing unit may scan and analyze the song for information. Once the process scans the song, metadata associated with the song content may be extracted and stored in a file associated with the song. The metadata may include for example, the key the song is played in and the beats per minute the song is played in. On playback, the song key and beats per minute are recognized. The process automatically sets the system to register only notes played in the song's stored key. The information is sent to the processing unit dedicated to controlling the playback user interface (shown as "control surface microprocessor"). The received information may be used to assign key correct notes to the force sensor resistors. The process automatically guides the user by sending out the through a port, the correct areas on the user interface/playback surface (for example, graphical plater layer 10) to touch in order and timing of the notes for the song. In an exemplary embodiment, the key correct notes are assigned over the FSRs 16 and root position is illuminated so that the user is accurately guided to trigger the correct note. The beats per minute data may be used to time the illumination of the demarcated areas 12. The registration of a user's touch may trigger the activation of a corresponding MIDI note. The note data may be sent simultaneously out a USB port and MIDI DIN port. An electronic musical instrument (for example, a synthesizer) may receive the MIDI note from the smart music device triggering play of the note. If another song is selected by the user, the automation once again flips to the key for that song automatically so that key correct areas of the graphic layer surface are illuminated and touching those areas will result in the correct key being played by a musical instrument connected to the smart music device. In another embodiment, the processing unit 510 may synchronize rhythm based sound patches with the beats per minute of the current song track being played.

As will be appreciated by one skilled in the art, aspects of the disclosed invention may be embodied as a system, method or process, or computer program product. Accordingly, aspects of the disclosed invention may take the form of an entirely hardware embodiment, an entirely software embodiment (including firmware, resident software, microcode, etc.) or an embodiment combining software and hardware aspects that may all generally be referred to herein as a "circuit," "module," or "system." Furthermore, aspects of the disclosed technology may take the form of a computer program product embodied in one or more computer readable media having computer readable program code embodied thereon.

In the context of this disclosure, a computer readable storage medium may be any tangible or non-transitory medium that can contain, or store a program (for example, the program product 540) for use by or in connection with an instruction execution system, apparatus, or device. A computer readable storage medium may be, for example, but not limited to, an electronic, magnetic, optical, electromagnetic, infrared, or semiconductor system, apparatus, or device, or any suitable combination of the foregoing.

Aspects of the disclosed invention are described above with reference to block diagrams of methods, apparatus (systems) and computer program products according to embodiments of the invention. It will be understood that each block of the block diagrams, and combinations of blocks in the flowchart illustrations and/or block diagrams, can be implemented by computer program instructions. These computer program instructions may be provided to the processing unit 510 of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A smart music device, comprising:

a graphical layer interface;

conductive translucent ink on an underside of the graphical layer interface, the conductive translucent ink demarcating areas representing musical notes on the graphical layer interface;

a layer of conductive sensors positioned below the conductive translucent ink demarcating areas representing musical notes, the layer of conductive sensors connected to a processing unit, wherein touching one of the areas demarcated to represent musical notes generates a conductive circuit between the translucent conductive ink, and an underlying conductive sensor, and the processing unit;

a LED source connected to the graphical layer interface and configured to illuminate the areas demarcated to represent musical notes;

input/output ports configured to communicate data to an electronic musical instrument;

data memory storage configured to electronically store song file metadata; and the processing unit configured to:

analyze the song file metadata for a song key, determine musical notes to be played in the song key, assign to the areas demarcated to represent musical notes, only musical notes in the song key;

illuminate the areas demarcated to represent only musical notes to be played in the song key, register a touch by the user of one of the demarcated areas in response to conductive ink under the touched demarcated area making contact with one of the conductive sensors, identify a musical note, in the song key, associated with the touched demarcated area, and send the identified musical note, in the song key, through the output port to the electronic musical instrument to be played.

2. The device of claim 1, wherein the song file metadata includes a beats per minute data used to time illumination of the demarcated areas.

3. The device of claim 1, wherein the graphical layer interface is vinyl.

4. The device of claim 1, wherein the demarcated areas and conductive translucent ink are configured to resemble buttons.

5. The device of claim 1, wherein the song key determined by the processing unit is read from incoming MIDI data.

6. A method for automatically generating only correct key notes and scales played through a smart music device, comprising:

receiving a song to be played;

analyzing the song for a song key;

storing the song key in a metadata file associated with the song;

receiving a request for playback of the song;

retrieving the song key from the metadata file;

assigning to user interface areas of the smart music device, only musical notes in the song key;

illuminating the user interface areas of the smart music device that represent a root position of musical notes played in the song key in an order of musical notes for the song;

registering a touch of user interface areas of the smart music device through a layer of conductive ink positioned on an underside of the user interface areas;

identifying a musical note associated with one of the user interface areas touched in response to a circuit formed between the layer of conductive ink and a processing unit; and sending a signal from the processing unit through an output port of the smart music device to an input port of an electronic musical instrument to play the identified musical note.

7. The method of claim 6, further comprising locking the user interface areas to only register notes played in the song key from the metadata file.

8. The method of claim 6, further comprising analyzing the song for a beats per minute data and illuminating the user interface areas of the smart music device based on the beats per minute data of the song.

9. The method of claim 8, further comprising synchronizing a rhythm based sound patch received by the smart music device with the beats per minute data.

10. The method of claim 6, further comprising reading incoming MIDI data through an input port and determining the song key from the incoming read MIDI data.

11. A smart music device, comprising:

a user interface including a plurality of buttons;

a light source positioned to illuminate the plurality of buttons;

an input port and an output port configured to communicate data to an electronic musical instrument;

data memory storage configured to electronically store song file metadata; and a processing unit configured to:

analyze the song file metadata for a song key, determine musical notes to be played in the song key, assign to the plurality of buttons, only musical notes in the song key;

lock the plurality of buttons to the song key;

illuminate, using the light source, one or more of the plurality of buttons of the musical notes to be played in the song key, register a touch by the user of one of the illuminated plurality of buttons of the musical notes to be played in the song key, identify a musical note associated with the touched one of the plurality of buttons, and sending the identified musical note through the output port to the electronic musical instrument to be played.

12. The device of claim 11, wherein the song file metadata includes a beats per minute data used to time illumination of the one or more of the plurality of buttons of the musical notes to be played in the song key.

13. The device of claim 11, wherein the song key determined by the processing unit is read from incoming MIDI data.

14. The device of claim 11, wherein the processing unit is further configured to read incoming MIDI data through the input port and determining the song key from the incoming read MIDI data.

15. The device of claim 11, wherein the illuminated one or more of the plurality of buttons is a root position musical note in the song key.

16. The device of claim 11, wherein the plurality of buttons are illuminated in a timing and order of notes to be played for a song in the song key.

* * * * *